United States Patent [19]

Archer et al.

[11] Patent Number: 4,638,274

[45] Date of Patent: Jan. 20, 1987

[54] RELAY SWITCH APPARATUS

[75] Inventors: Wendel E. Archer, Gahanna; James L. Milton, Columbus, both of Ohio; Paul W. Renaut; Nelson H. Winquist, both of Lee's Summit, Mo.

[73] Assignee: AT&T Bell Laboratories, Murray Hill, N.J.

[21] Appl. No.: 836,681

[22] Filed: Mar. 6, 1986

[51] Int. Cl.[4] ..... H01H 1/08; H01H 29/00

[52] U.S. Cl. ..... 335/52; 335/55; 335/58

[58] Field of Search ..... 335/52, 51, 53, 49, 335/55, 56, 57, 58, 50; 200/182, 209, 210

[56] References Cited

U.S. PATENT DOCUMENTS

| | | | |
|---|---|---|---|
| 3,867,603 | 2/1975 | Bitko | 200/239 |
| 3,904,999 | 9/1975 | Rich et al. | 335/52 |
| 3,976,960 | 8/1976 | Bitko et al. | 335/58 |
| 4,047,135 | 9/1977 | Stuckert | 335/58 |
| 4,164,720 | 8/1979 | Bollen | 335/47 |
| 4,199,739 | 4/1980 | Deith | 335/58 |
| 4,260,970 | 4/1981 | Bitko | 335/52 |

*Primary Examiner*—Harold Broome

*Attorney, Agent, or Firm*—Dwight A. Marshall

[57] ABSTRACT

A multi-positional mercury switch (1, 2, 3) for use with miniature relays (4). The mercury switch apparatus has mercury wettable magnetic contact structures (11, 12, 211, 212, 221, 222, 311, 312) supported in a sealed envelope member (10, 20, 30) supporting the magnetic contact structures with ends thereof extending from the envelope member for interconnection with terminals of the relay. A mercury holding assembly (13, 14, 23, 24, 33, 34) is slidably located within the sealed envelope member adjacent the magnetic contact structures and is responsive to an external magnetic field generated by electrical signals in a coil (410) surrounding the sealed envelope member for engaging the magnetic contact structures and establishing an electrical conducting path between the magnetic contact structures.

8 Claims, 4 Drawing Figures

RELAY SWITCH APPARATUS

BACKGROUND OF THE INVENTION

1. Field of the Invention

This invention relates to relay apparatus. In particular, it relates to electromagnetically actuated switches of mercury relay apparatus.

2. Description of the Prior Art

Sealed contact switches are well known in the Electronic and Communication Industry and have found extensive application in electrical systems for performing a wide range of switching functions. A typical switch comprises contact members suspended at their ends by an envelope member such as a sealed glass envelope. A relay is constructed utilizing a switch such that a coil winding encircling the envelope member is energizable to generate a magnetic field for actuating the contact members of the switch to engage and disengage contact surfaces thereby controlling an external electrical circuit connected with the switch contact members. Such switches serve well in particular circuit applications. However, the irregular surface character of the contact members reduce the contact surface area of the electrical connection upon engagement of the contact surfaces and renders the switch essentially current limited in that current of a magnitude beyond a predetermined value tends to cause melting of the irregular contact surfaces. The melting of the contact surfaces increases the tendency of the contact members to stick together in a closed position.

The current carrying capacities of such switches may be increased by the employment of the well-known mercury-wetted type switches. Typically, mercury wettable surfaces enable an electrical connection to be uniformly established over the entire area of the contact surfaces. In such a switch, a pool of mercury located in one end of the sealed envelope member moves by capillary action over one contact member to wet both contact surfaces and thereby increase the current capacity of the switch. A problem occurs with mercury switches in that they are position sensitive. If they are mounted in one position, the pool of mercury will shift thereby shorting the contact members together rendering the switch inoperable. If the switch is mounted in another position, the pool of mercury may be shifted to a location within the switch away from the contact members thereby creating dry contacts that result in a lower current carrying capacity of the switch.

Accordingly, a need exists for a multi-positional mercury switch that may be mounted in various positions in electrical and electronic equipment. A need also exists for a mercury relay having a multi-positional switch assembly that requires less mercury to obtain the current rating of previous switch assemblies.

SUMMARY OF THE INVENTION

The foregoing problems are solved and a technical advantage is achieved by a mercury switch construction having a mercury holding sleeve assembly slidably located within a sealed envelope member adjacent magnetic contact structures and having a soft magnet attached thereto that is responsive to an external magnetic field for engaging the mercury holding sleeve assembly with the magnetic structures and establishing electrical conducting paths between the magnetic structures.

In accordance with the invention, a mercury switch construction comprises a soft magnetic pin and a hard magnetic pin oppositely supported at ends of a sealed envelope member with the pins extending from the sealed envelope ends for interconnection with terminals of a relay housing. A nonmagnetic mercury wetted cylindrical shell member is slidably located within the sealed envelope housing having an axial bore with one end sized to slidably receive the hard magnetic pin in continuous electrical engagement and the opposite end sized to receive the soft magnetic pin in a spaced apart relationship. A mercury wettable magnetic plug positioned within the shell member bore and in electrical engagement with the shell member is responsive to an external applied magnetic field for engaging the soft magnetic pin and establishing an electrical conducting path between the soft and hard magnetic pins.

Also in accordance with the invention, a mercury transfer contact switch construction comprises a pair of soft magnetic pins and a pair of hard magnetic pins each oppositely supported at ends of a sealed envelope member with the pair of soft and hard magnetic pins extended from ends of the sealed envelope for interconnection with terminals of a relay housing. A nonmagnetic mercury wetted cylindrical shell member is slidably located within the sealed envelope member and has each end sized to slidably receive the pair of the soft and hard magnetic pins respectively in a spaced apart relationship. A mercury wettable soft magnetic plug is positioned within the shell member in electrical engagement therewith and is responsive to an external applied magnetic field for engaging said soft and hard magnetic pins and establishing an electrical conducting path between each pair of soft and hard magnetic pins.

In further accordance with the invention, a multipositional magnetic mercury relay comprises a housing having terminals and a bobbin located in the housing with an energizing coil wound thereon with the coil connected to ones of the housing terminals. A switch enclosed by the bobbin and coupled with other ones of the housing terminals interconnects ones of the switch terminals in response to a magnetic field generated by electrical signals applied to the coil terminals. The switch comprises a pair of soft magnetic pins supported at one end of a sealed envelope member with ends thereof extending outward from the sealed envelope member for interconnection with the housing switch terminals. A permanent magnet is positioned outside the end of the sealed envelope member opposite the pair of soft magnetic pins and a nonmagnetic mercury wetted cylindrical shell member is slidably located with the sealed envelope member and has an axial bore sized for receiving the pair of soft magnetic pins at one end thereof in a spaced apart relationship. A mercury wettable soft magnetic plug positioned within the other end of the shell member bore and forming a mercury wetted cup therewith is normally attracted to the permanent magnet with the mercury holding cup disengaged from the pair of soft magnetic pins. The soft magnetic plug is responsive to the magnetic field generated by the coil for engaging the mercury holding cup with ends of the pair of soft magnetic pins and establishing an electrical conducting path between the pair of soft magnetic pins.

DESCRIPTION OF THE DRAWING

The foregoing as well as other objects, features and advantages of the invention will be more apparent from a description of the drawing in which.

DESCRIPTION OF THE INVENTION

Figure 1:
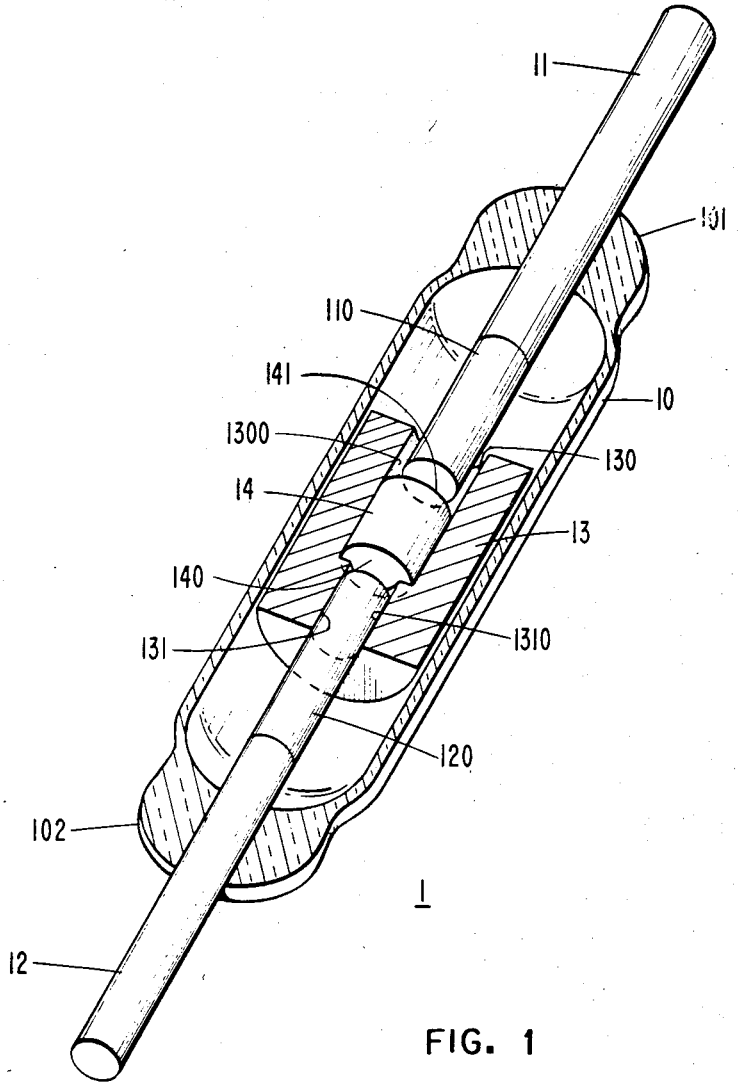
FIG. 1 is a perspective view illustrating switch apparatus embodying the principles of the instant invention.

Referring now to FIG. 1 of the drawing, the switch apparatus set forth therein is a mercury switch construction having mercury wettable magnetic contact structures wherein electrical conducting paths are established by operation of the switch between a pair of magnetic pins. More specifically, in a first embodiment of the invention, mercury switch apparatus 1 has a pair of magnetic pins (11, 12). One of the magnetic pins, hereinafter referred to as soft magnetic pin 11, is formed of a mercury wettable and electrical conducting nickel-iron alloy sometimes referred to as 52 permalloy. The opposite pole-piece, hereinafter referred to as hard magnetic pin 12, is formed of a mercury wettable and electrical conducting alloy such as iron-cobalt-vanadium.

Both soft and hard magnetic pins 11 and 12 are chrome-plated and oxidized to form a non-mercury wettable surface which will enable envelope member 10 to be sealed around each pin. Each magnetic pin is ground or subjected to an electronic discharge to expose an end thereof to form mercury wettable surfaces 110 and 120.

In assembly, an envelope member 10, which typically may be a glass envelope, is arranged to support the pair of magnetic pins 11, 12, each at one end 101 and 102, respectively, with mercury surfaces 110 and 120 aligned and positioned in a spaced apart relationship with the ends thereof facing each other. Envelope member ends 101 and 102 are sealed about the chrome portions of magnetic pins 11 and 12.

A shell member 13 formed of a non-magnetic and mercury wettable electrical conducting material such as a nickel, copper and tin alloy is slidably positioned within envelope member 10 and is free to move along an axial centerline thereof. A first bore 131 is formed within one end of shell member 13 and is sized to slidably receive the mercury wettable surface 120 of hard magnetic pin 12 such that a continuous electrical engagement is maintained between hard magnetic pin 12, the mercury wettable surfaces 120 and 1310 and shell member 13 as shell member 13 moves within envelope member 10.

The opposite end of shell member 13 is formed with another bore 130 sized to surround soft magnetic pin 11 such that magnetic wettable surface 110 thereof is maintained in a spaced apart and electrical non-conducting relationship with mercury wettable, surface 1300 of bore 130. Bore 130 is also sized to receive a soft magnetic plug member 14 formed of the aforementioned mercury wettable and electrical conducting nickel-iron alloy. Magnetic plug member 14 is fitted with an interference fit into bore 130 of shell member 13 and forms two mercury holding cups at each end of shell member 13. One mercury holding cup comprises mercury wettable surfaces 1310 of shell member 13 and 140 of magnetic plug 14 and continuously engages end 120 of hard magnetic pin 12 and maintains an electrical conducting path between hard magnetic pin 12 and shell member 13. The other mercury cup comprises mercury wettable surfaces 1300 and 141 of shell member 13 and magnetic plug 14 respectively. In the open state of switch apparatus 1, soft magnetic plug 14 is magnetically attracted to hard magnetic pin 12 thereby maintaining the mercury cup comprising mercury wettable surfaces 1300 and 141 in a spaced apart non-conducting relationship with soft magnetic pin 11.

Figure 4:
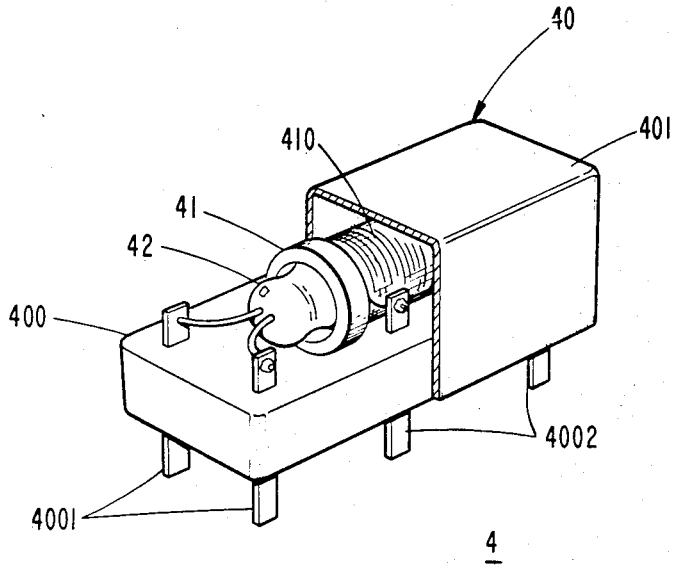
FIG. 4 sets forth a perspective view of a multi-positional mercury relay employing the switch apparatus set forth in FIGS. 1, 2 and 3.

An external magnetic field generated by an electrical signal applied to an energizing coil 410, FIG. 4, surrounding envelope member 10, FIG. 1, attracts magnetic member 14 to soft magnetic pin 11. The attraction between soft magnetic pin 11 and soft magnetic member 14 will be larger than the attraction between soft magnetic member 14 and hard magnetic pin 12 for one of two reasons: (1) The cross-sectional area of soft magnetic pin 11 may be larger than the area of hard magnetic pin 12; and (2) the saturation flux of the material used for soft magnetic pin 11 may be larger than that of hard magnetic pin 12. Since soft magnetic member 14 is affixed to shell member 13, shell member 13 slides in envelope member 10 to engage mercury wetted surface 141 of soft magnetic plug 14 with end 110 of soft magnetic pin 11. An electrical conducting path is thereby established from soft magnetic pin 11 through mercury wetted surfaces 110, 141, soft magnetic plug 14, shell member 13 and mercury wetted surfaces 1310, 120 to hard magnetic pin 12.

The removal of the external magnetic field thereby enables hard magnetic pin 12 to exert an attraction force on soft magnetic plug 14 such that shell member 13 slides within envelope member 10 towards hard magnetic pin 12. Mercury wetted surface 141 of soft magnetic plug 14 is thereby disengaged from mercury wetted end 110 of soft magnetic pin 11. Thus, the mercury cup formed by the mercury wetted surfaces 1300, 141 of shell member 13 and soft magnetic plug 14, respectively, returns to a spaced apart relationship with respect to soft magnetic pin end 110 thereby opening the electrical conduction path of switch apparatus 1 between hard and soft magnetic pins 12 and 11.

Figure 2:
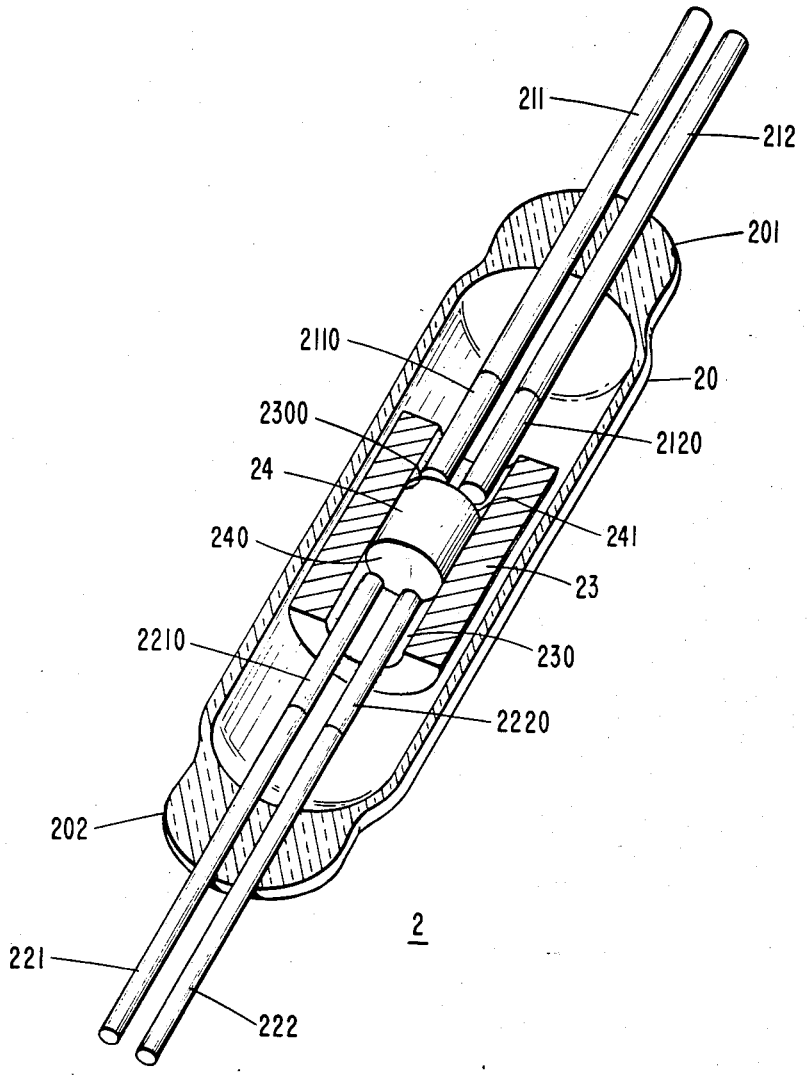
FIG. 2 depicts in perspective view transfer contact switch apparatus embodying the principles of the instant invention.

In another embodiment of the invention, switch apparatus 2 set forth in FIG. 2 of the drawing, comprises a pair of soft magnetic pins 211, 212 and a pair of hard magnetic pins 221, 222 with each pair of magnetic pins oppositely supported at ends 201, 202 of a sealed envelope member 20. A shell member 23, formed of the aforementioned mercury wettable and electrically conducting nickel, copper, and tin alloy and having an axial bore 230, is slidably located within sealed envelope member 20. Bore 230 surrounded by mercury wetted side wall 2300 is sized to receive at each end one of the pair of soft and hard magnetic pins 211, 212 and 221, 222 such that the mercury wettable ends 2110, 2120 and 2210, 2220 thereof are positioned in a spaced apart non-conducting relationship with shell member bore side wall 2300. Magnetic plug 24 is positioned by an interference fit within bore 230 at the center of shell member 23 so that a mercury cup is formed at each end of shell member 23 consisting of the mercury wetted surfaces 2300 and 240, 241 of shell member 23 and soft magnetic plug 24, respectively.

In one state, soft magnetic plug 24 is magnetically attracted to hard magnetic pins 221, 222 so that shell member 23 moves along the inner walls of sealed envelope member 20 toward hard magnetic pins 221, 222.

Movement of shell member 23 toward hard magnetic pins 221, 222 results in the engagement of the mercury wetted surface 240 with the mercury wettable ends 2210, 2220 of hard magnetic pins 221, 222 so that an electrical conducting path is established between hard magnetic pins 221, 222. Movement of shell member 23 to engage hard magnetic pins 221, 222 disengages magnetic plug surface 241 from soft magnetic pin ends 2110, 2120 thereby opening an electrical path previously established between soft magnetic pins 211 and 212.

In another state, an external magnetic field generated by an electrical signal applied to a coil surrounding envelope member 20 changes the polarity of soft magnetic plug 24 and pins 211, 212. As a result, soft magnetic plug 24 is repelled from hard magnetic pins 221, 222 and attracted to soft magnetic pins 211, 212 such that shell member 23 moves toward soft magnetic pins 211, 212. Mercury wetted surface 240 is disengaged from hard magnetic pin ends 2210, 2220 to open the electrical conducting path between hard magnetic pins 221, 222 and mercury wetted surface 241 is engaged with soft magnetic pin ends 2110, 2120 to establish an electrical conducting path between soft magnetic pins 211, 212. Removal of the external magnetic field returns switch apparatus 20 to the first state wherein soft magnetic plug 24 is attracted to hard magnetic pins 221, 222 with shell member 23 moving to engage mercury wetted surface 240 with hard magnetic pin ends 2210 and 2220. Thus, a transfer contract switch construction exists wherein an electrical conducting path has been transferred between hard magnetic pins 221, 222 and soft magnetic pins 211, 212.

Figure 3:
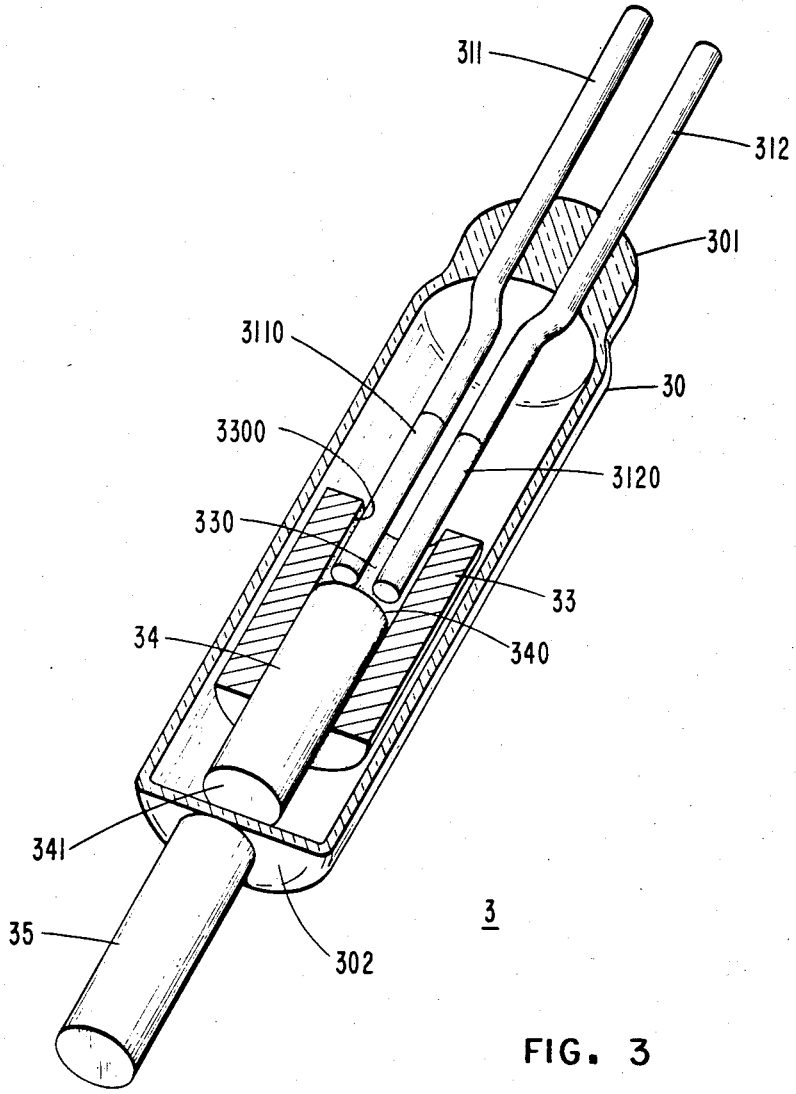
FIG. 3 sets forth details of yet other switch apparatus embodying the principles of the invention set forth in FIGS. 1 and 2.

In another embodiment of the invention, switch apparatus 3, set forth in FIG. 3 of the drawing, has a pair of soft magnetic pins 311, 312 formed of the aforementioned oxidized chrome-plated nickel-iron alloy which are supported in a parallel relationship at one end 301 of a sealed envelope member 30 with chrome-free mercury wettable ends 3110, 3120 extended into sealed envelope member 30. A non-magnetic and mercury wettable shell member 33 is slidably located within sealed envelope member 30 and has an axial bore 330 therein having a mercury wettable sidewall 3300 sized to receive soft magnetic pin ends 3110, 3120 at one end thereof in a spaced apart relationship with respect to shell member sidewall 3300. Soft magnetic plug member 34, formed of the aforementioned electrical conducting and mercury wettable nickel-iron alloy, is positioned by an interference fit in the opposite end of shell member bore 330 such that mercury wetted end 340 of soft magnetic plug 34, in combination with shell member bore sidewall 3300, forms a magnetic cup surrounding the soft magnetic pin ends 3110, 3120. End 341 of soft magnetic plug 34 extends outward from the opposite end of shell member bore 330 and is normally attracted to permanent magnet member 35. Permanent magnet member 35 may be formed of a metallic alloy, such as an aluminum, cobalt, copper, iron, nickel and titanium, and is located outside and adjacent one end 302 of sealed envelope member 30 opposite the pair of soft magnetic pins 311, 312.

In one state of switch apparatus 3, permanent magnet member 35 exerts a magnetic attraction force on soft magnetic member 34 to move shell member 33 within sealed envelope member 30 and maintain the aforementioned mercury cup comprising mercury wetted surfaces 3300, 340 disengaged with ends 3110, 3120 of soft magnetic pins 311, 312 thereby maintaining switch apparatus 3 in an open state.

An external magnetic field generated by an electrical signal applied to an energizing coil 410, FIG. 4, surrounding switch apparatus 30, FIG. 3, attracts soft magnetic plug 34 towards soft magnetic pins 311, 312. Shell member 33 is moved by soft magnetic plug 34 toward soft magnetic pins 311, 312 to engage mercury wetted surface 340 with soft magnetic pin ends 3110, 3120 thereby establishing an electrical conducting path between soft magnetic pins 311 and 312.

Removal of the electrical signal from energizing coil 410 results in soft magnetic plug 34 being attracted to hard magnetic member 35 thereby moving shell member 33 to disengage mercury wetted surface 340 from soft magnetic pin ends 3110, 3120 and opening the electrical conducting path between soft magnetic pins 311 and 312.

Switch apparatus 1, 2 and 3 may be a part of a multipositional mercury relay such as magnetic mercury relay 4 set forth in FIG. 4 of the drawing. Relay 4 has a housing 40 comprising a cover member 401 and a base member 400 with a number of terminals 4001, 4002 embedded therein and extending from top and bottom surfaces thereof. Bobbin member 41 is located within housing 40 and has an energizing coil 410 wound thereon with the coil leads connected to base terminals 4002. Switch apparatus 42 may be switch apparatus 1, 2 and 3 as set forth in FIGS. 1, 2 and 3, respectively, and is enclosed by bobbin member 41 and energizing coil 410 with the switch apparatus magnetic pins 11, 12, 211, 212, 221, 222, 311, 312 coupled to other base member terminals 4001. Electrical signals applied to the coil terminals 4002 enable switch apparatus 42 to interconnect magnetic pins 11, 12, 211, 212, 221, 222, 311 and 312 thereby establishing electrical paths between terminals 4001.

The shell assembly of each switch apparatus 1, 2, 3 comprising non-magnetic shell member 13, 23, 33 and soft magnetic plug 14, 24, 34, forms mercury holding cups that have mercury wetted surfaces. These wetted surfaces retain mercury regardless of the position of switch apparatus 1, 2, 3 and thereby enable mercury relay 4 to be mounted in any position.

SUMMARY

It is obvious from the foregoing that the facility, economy and efficiency of mercury relays may be substantially enhanced by mercury switch apparatus that enables a mercury relay to be mounted in any position in electrical and electronic equipment. It is further obvious from the foregoing that a mercury switch construction with a mercury wetted shell member having a magnetic plug forming mercury cups holding small amounts of mercury and slidably located in a sealed envelope for wetting and establishing electrical conducting paths between contact structures regardless of the mounting position of the mercury switch construction improves the use of mercury relays in electrical and electronic equipment.

What is claimed is:

1. A mercury switch construction (1, 2, 3) comprising mercury wettable magnetic contact structures (11, 12, 211, 212, 221, 222, 311, 312), envelope means (10, 20, 30) for supporting said magnetic contact structures in a spaced apart relationship, and means responsible to an external magnetic field for establishing an electrical conducting path between said magnetic contact structures characterized in that said electrical conducting path establishing means comprises mercury holding means (13, 23, 33) slidably located within said envelope means adjacent said magnetic contact structures and having magnetic means (14, 24, 34) attached thereto responsive to said external magnetic field for engaging said mercury holding means with said contact structures and establishing said electrical conducting path.

2. The mercury switch construction set forth in claim 1 characterized in that said electrical conducting path establishing means comprises nonmagnetic cylindrical shell means (13, 23, 33) slidably located within said envelope means and having a mercury wetted inner surface (1300, 1310, 2300, 3300) surrounding said magnetic contact structures in a spaced apart relationship, and magnetic means (14, 24, 34) located within said cylindrical means and forming a mercury wetted cup about said magnetic contact structures and responsive to said external magnetic field for engaging said mercury cup with said magnetic contact structures and establishing said electrical path.

3. The mercury switch construction set forth in claim 2 characterized in that said mercury switch construction (1)

wherein said contact structures comprise a soft magnetic pin (11) and a hard magnetic pin (12) each oppositely supported at ends of said envelope means, wherein said nonmagnetic cylindrical shell means comprises a mercury wetted shell member (13) slidably located within said envelope means having one end sized to slidably receive said hard magnetic pin in continuous electrical engagement and the other end sized to receive said soft magnetic pin in a spaced apart relationship, and wherein said magnetic means comprises a magnetic plug (14) positioned within said shell member normally in electrical engagement at said shell member one end with said hard magnetic pin and responsive to said external magnetic field for engaging a mercury cup formed at said shell member other end with said soft magnetic pin to establish said electrical conducting path between said soft and hard magnetic pins.

4. The mercury switch construction set forth in claim 2 characterized in that said mercury switch construction (2)

wherein said contact structures comprise a pair of soft magnetic pins (211, 212) and a pair of hard magnetic pins (221, 222) with each pair of said magnetic pins oppositely supported at ends of said envelope means, wherein said nonmagnetic cylindrical shell means comprises a mercury wetted shell member (23) slidably located within said envelope means and having a bore at each end sized to surround said pair of hard magnetic pins and said pair of soft magnetic pins in a spaced apart relationship respectively, and wherein said magnetic means comprises a magnetic plug (24) positioned within said shell member forming mercury cups at each end of said shell member and responsive to said external magnetic field for engaging said mercury cups with said soft and hard magnetic pins to establish electrical paths between said pair of soft magnetic pins and between said pair of hard magnetic pins.

5. The mercury switch construction set forth in claim 2 characterized in that said mercury switch construction (3)

wherein a permanent magnet (35) is located outside and at one end of said envelope means, wherein said magnetic contact structures comprises a pair of soft magnetic pins (311, 312) supported at an end of said envelope means opposite said permanent magnet, wherein said nonmagnetic cylindrical means comprises a nonmagnetic shell member (33) slidably located within said envelope means and having a center bore with a mercury wetted side wall sized for receiving said pair of soft magnetic pins in a spaced apart relationship at one end thereof, and wherein said magnetic means comprises a soft magnetic plug (34) fitted into said shell member center bore forming a mercury cup therewith and extending from said center bore and responsive to said external magnetic field and said permanent magnet for engaging and disengaging said mercury cup with said soft magnetic pins to establish said electrical conducting path.

6. A multi-positional magnetic mercury relay (4) comprising a housing (40) having terminals (4001, 4002) extending therefrom, a bobbin (41) located in said housing and having an energizing coil (410) wound thereon with the coil connected to ones of said terminals, and switch means (42) enclosed by said bobbin and coupled to other ones of said terminals for interconnecting said switch terminals in response to a magnetic field generated by electrical signals applied to said coil terminals characterized in that said switch means comprises a soft magnetic pin (11), a hard magnetic pin (12), a sealed envelope member (10) for oppositely supporting said soft and hard magnetic pins at ends thereof with said soft and hard magnetic pins extending from said sealed envelope ends for interconnection with said switch terminals, a nonmagnetic mercury wetted cylindrical shell member (13) slidably located within said sealed envelope member having one end sized to slidably receive said hard magnetic pin in continuous electrical engagement and the other end sized to receive said soft magnetic pin in a spaced apart relationship, and a mercury wettable soft magnetic plug (14) positioned within said shell member in electrical engagement with said hard magnetic pin and responsive to external magnetic field for engaging said soft magnetic pin and establishing an electrical conducting path between said soft and hard magnetic pins.

7. A multi-positional magnetic mercury relay (4) comprising a housing (40) having terminals (4001, 4002) extending therefrom, a bobbin (41) located in said housing and having an energizing coil (410) wound thereon with the coil connected to ones of said terminals, and switch means (41) enclosed by said bobbin and coupled to other ones of said terminals for interconnecting said switch terminals in response to a magnetic field generated by electrical signals applied to said coil terminals characterized in that said switch means comprises a pair of soft magnetic pins (211, 212), a pair of hard magnetic pins (221, 222), a sealed envelope member (20) for oppositely supporting said soft and hard magnetic pins at ends thereof with said soft and hard magnetic pins extending from said sealed envelope ends for interconnection with said switch terminals, a nonmagnetic mercury wetted cylindrical shell member (23) slidably located within said sealed envelope member having one end sized to slidably receive said hard magnetic pins and the other end sized to receive said soft magnetic pins in a spaced apart relationship, and a mercury wettable soft magnetic plug (24) positioned within said shell member in electric engagement therewith and responsive to said external magnetic field for engaging said soft and hard magnetic pins and establishing an electrical conducting path between said pair of soft magnetic pins and between said pair of hard magnetic pins.

8. A multi-positional magnetic mercury relay (4) comprising a housing (40) having terminals (4001, 4002) extending therefrom, a bobbin (41) located in said housing and having an energizing coil (410) wound thereon with the coil connected to ones of said terminals, and switch means (41) enclosed by said bobbin and coupled to other ones of said terminals for interconnecting said switch terminals in response to a magnetic field generated by electrical signals applied to said coil terminals characterized in that said switch means comprises a pair of soft magnetic pins (311, 312), a sealed envelope member (30) for supporting said pair of soft magnetic pins at one end thereof with said pair of soft magnetic pins extending from said sealed envelope end for interconnection with said switch terminals, a permanent magnet (35) positioned outside of said sealed envelope adjacent another end of said sealed envelope opposite said pair of soft magnetic pins, a nonmagnetic mercury wetted cylindrical shell member (33) slidably located within said sealed envelope member having a common bore (330) sized for receiving said pair of soft magnetic pins in a spaced apart relationship at one end thereof, and a mercury wettable soft magnetic plug (34) positioned within said shell member bore at the other end thereof forming a mercury wetted cup at said one end and normally attracted to said permanent magnet with said mercury wetted cup disengaged from said pair of soft magnetic pins and responsive to said magnetic field for engaging said mercury wetted cup with said pair of soft magnetic pins and establishing an electrical conducting path between said pair of soft magnetic pins.

* * * * *